US006581670B1

(12) United States Patent
Fink et al.

(10) Patent No.: US 6,581,670 B1
(45) Date of Patent: Jun. 24, 2003

(54) INJECTION UNIT FOR A PRESSURE DIE CASTING MACHINE

(75) Inventors: Roland Fink, Winterbach (DE); Norbert Erhard, Lorch (DE); Herbert Noschilla, Schorndorf (DE); Bruno Stillhard, St. Gallen (CH); Ronald Siegrist, Oberuzwil (CH)

(73) Assignee: Oskar Frech GmbH & Co., Schorndorf (DE)

( * ) Notice: Subject to any disclaimer, the term of this patent is extended or adjusted under 35 U.S.C. 154(b) by 0 days.

(21) Appl. No.: 09/762,047

(22) PCT Filed: May 31, 2000

(86) PCT No.: PCT/EP00/04977

§ 371 (c)(1),
(2), (4) Date: Jun. 7, 2001

(87) PCT Pub. No.: WO00/72998

PCT Pub. Date: Dec. 7, 2000

(30) Foreign Application Priority Data

Jun. 1, 1999 (EP) ..... 99 109 360

(51) Int. Cl.[7] ..... B22D 17/04

(52) U.S. Cl. ..... 164/319; 164/316; 425/557

(58) Field of Search ..... 164/312, 313, 164/314, 315, 316, 317, 318, 319, 320; 425/DIG. 228, 557, 561

(56) References Cited

U.S. PATENT DOCUMENTS

| | | | | |
|---|---|---|---|---|
| 3,920,099 A | * | 11/1975 | Pondelicek et al. | 184/55 A |
| 3,971,432 A | * | 7/1976 | Hardey | 164/318 |
| 4,311,185 A | | 1/1982 | Zimmerman | 164/315 |
| 4,884,621 A | * | 12/1989 | Ban et al. | 164/4.1 |
| 5,482,101 A | | 1/1996 | Fink | 164/312 |
| 5,632,321 A | * | 5/1997 | Hegel et al. | 164/315 |

FOREIGN PATENT DOCUMENTS

| | | | |
|---|---|---|---|
| DE | 41 01 551 A1 | | 7/1992 |
| DE | 43 45 034 A1 | | 10/1994 |
| DE | 44 41 735 A1 | | 5/1996 |
| EP | 0 430 616 A1 | | 6/1991 |
| EP | 0 618 025 A1 | | 10/1994 |
| FR | 908 322 | | 4/1946 |
| FR | 1 517 113 | | 3/1968 |
| FR | 2 570 006 A1 | | 3/1986 |
| JP | 59-54457 | * | 3/1984 |
| JP | 07-155925 | | 6/1995 |

OTHER PUBLICATIONS

"LUEGER Lexikon der Technik", vol. 12—Automotive Engineering (1967), 223.

International Search Report for PCT/EP 00/ 04977 (dated Sep. 14, 2000).

* cited by examiner

*Primary Examiner*—M. Alexandra Elve
*Assistant Examiner*—Len Tran
(74) *Attorney, Agent, or Firm*—Crowell & Moring LLP

(57) ABSTRACT

A pressing-in unit for a hot-chamber pressure diecasting machine permits an electro-mechanical drive for the casting plunger. In order to absorb the moments of inertia of the drive which occur during the switch-over of the casting plunger drive from the mold filling phase to the after-pressure phase, a spring element in the form of a plastic component or a liquid spring is inserted between the casting plunger and the pusher rod moved by the electric drive, which spring element is compressed by the additional path which the pusher rod still covers after the braking of the motor. The extent of the compression is selected such that the resulting axial force which is exercised by the plastic component or by the liquid spring is sufficient for causing the desired after-pressure in the molten metal.

28 Claims, 6 Drawing Sheets

INJECTION UNIT FOR A PRESSURE DIE CASTING MACHINE

BACKGROUND AND SUMMARY OF THE INVENTION

The invention relates to a pressing-in unit for a pressure diecasting machine, particularly for a hot-chamber pressure diecasting machine for processing molten metals, having a casting plunger for pressing the casting material into a mold, which casting plunger can be acted upon by way of a pusher rod which is connected with a linear drive driven by an electric motor, which linear drive, after the filling phase of the mold, is held in a pressure phase for achieving a pressure in the casting material, a spring element being connected between the casting plunger and the pusher rod.

From European Patent Document EP 0 430 616 A1, a pressing-in unit is known, in which a spindle is provided as a linear drive for driving a nut. The drive of the casting plunger connected with the linear drive takes place by way of a belt driven by an electric motor. In this case, the belt drive acts upon the spindle by way of an electromagnetically controllable disk coupling so that, in this manner, the advancing speed of the casting plunger and, after the filing of the mold, the pressure to be maintained in the casting material can be controlled. A rotational-speed-dependent signal, which is emitted by a speedometer connected with the spindle drive, is used for the control. A drive of this type for the pressing-in unit requires relatively high expenditures. Mainly because of the susceptibility of such couplings to wear, the controlling and regulating of the disk coupling has disadvantages.

From the Patent Abstract of Japanese Patent 0 7155 925, a pressing-in unit of the initially mentioned type for a pressure diecasting machine is known, in which an elastic spring element is connected between the casting plunger and the pusher rod and avoids undesirable pressure peaks which, as a result of the system, arise during the stopping of the drive and during the transition to the regulating of the pressure because of the forces of inertia inherent to the drive. While such problems do not occur in the case of plastic injection molding machines because of the elastic behavior of liquid plastic masses, the conditions in the case of pressure casting machines for processing molten metal are different in that the molten metal can virtually not be compressed.

In the case of injection molding machines for the processing of liquid plastic masses, it is also known to control the extruder spindles provided there for the pressing-out by means of electronic regulators such that, in the critical phases of the ram pressure buildup during the melting as well as when maintaining the pressure in the after-pressure phase, the desired advancing rates or torques can be exercised for maintaining the pressure (German Patent Document DE 43 45 034 A1). Information is also supplied there that a similar driving principle can also be used in the case of pressure casting machines if an elastic element is connected between the drive and the movable injection elements.

It is an object of the present invention to construct a pressing-in unit of the initially mentioned type in a manner which is as simple as possible.

In order to obtain a simple type of construction, it is provided in the case of a pressing-in unit of the initially mentioned type according to the invention that the spring element is constructed as an elastic plastic component or as a liquid spring and is designed such that the reaction force onto the casting plunger resulting from its prestressing will be high enough for applying the axial force to the casting plunger which is required for achieving the required pressure in the casting material. Such a spring element can absorb the moment of inertia occurring during the braking of the drive. The resulting spring travel prevents the further displacement of the casting plunger and thus also the occurrence of pressure peaks without the requirement of complicated control measures.

Thus, with respect to a pressing-in unit of the initially mentioned type, two objects are achieved according to the invention. On the one hand, the moments of inertia caused during the braking of the drive by the masses of the electric motor and of the transmission can be absorbed. Thus, as of the point in time of the switch-over from filling the mold to pressure, the casting plunger is no longer advanced. On the other hand, the additional travel occurring as the result of the moments of inertia is used for prestressing the spring element and the then generated prestress is utilized for acting upon the casting plunger by means of an axial force which is high enough for maintaining the desired after-pressure in the casting material.

These measures simplify the controlling of the casting plunger. The reason is that the regulating of the after-pressure can be reduced in this manner to a secondary speed control in a regulator cascade with a primary automatic power control.

As a further development of the invention, a sensor, which is connected with the control of the drive, can be assigned to the spring element. This sensor detects the axial force exercised by the spring element and correspondingly influences the drive control. As a result, the electric drive can be controllable such that the spring element is not compressed beyond a predefined extent.

As a further development of the invention, an elastic plastic ring can be provided as a spring element which is held between two flanges, of which one is held on the pusher rod and the other is fixedly connected with a sleeve telescopically guided on the pusher rod. The relative movement between the pusher rod and the sleeve compresses the plastic ring, specifically by an extent which corresponds to the adjusting path of the pusher rod caused by the after-running of the drive after the braking operation. It was found that such a plastic ring, particularly if it consists of a coated polyurethane caoutchouc, can apply the high forces occurring in the case of pressure diecasting machines for the compression of the molten metal. This plastic ring can also be constructed of two or several parts which can be deformed successively, so that different spring characteristics can also be implemented for the absorption of the moment of inertia and then for the application of the axial pressure force.

In a constructively simple manner, the pusher rod may have an extension of a smaller diameter which penetrates the plastic ring and on which the sleeve is also carried. The step provided between the extension and the pusher rod can then be used as a bearing for the disk held on the pusher rod and for a pressure sensor assigned to this disk. It is also conceivable in this case that the spring element and the arrangement of the sleeve are coordinated with one another such that the extension can be adjusted only a certain path relative to the sleeve.

As in the prior art, a threaded drive can be provided in a simple manner as the linear drive which consists of a spindle and a nut guided thereon. However, it is also conceivable to provide a rack-and-pinion drive as the linear drive which permits a robust construction and also has a low noise development. The rack-and-pinion drive can take place by way of a transmission which is applied to both sides of the rack, so that no one-sided stressing of the rack occurs. In the case of such a method of construction, two motors can also be provided for driving the transmission so that a power adaptation with higher dynamics as well as a higher acceleration and deceleration becomes conceivable. The transmission may be completely encapsulated, so that no oil outflow is possible in the direction of the molten bath.

However, the linear drive can finally also be a carriage guide driven by a connecting rod of a crank mechanism, in which case, if a certain vertical adjustment is provided, an optimal adaptation of the power course is conceivable to the mold filling stroke.

However, a liquid spring, which is known per se, can also be provided as the spring element ("LUEGER Lexikon der Technik", Volume 12—Automotive Engineering—Edition 1967, Verlag DVA Stuttgart, Page 223). At the pressing-in forces in the order of several tons occurring in the case of pressure diecasting machines, such cylinder/piston units, which as a rule are filled with oil, can provide the required spring travel, in which case, the spring force can then also here be utilized for acting upon the casting plunger.

In a practical embodiment, the liquid spring can be provided with an immersion piston which, by the force of a spring, is pressed into the interior of the cylinder in order to subject the liquid to a certain prestress even before it is acted upon by the pusher rod. As a further development of the invention, the cylinder of the liquid spring can also be provided with an opening to which an excess pressure limiting valve and a pump are connected for the possible return of exited liquid. A compressive strain converter can be connected to the connection line to the pressure limiting valve, which converter can, in turn, be connected with the control of an electric-motor drive.

However, additional liquid volumes can advantageously also be connected to the connecting line. The controllable connection of the liquid volume contributes to the change of the spring characteristic. Also when a liquid spring is used, an adaptation of the spring characteristic can also be achieved in this manner which is similar to that of a multipart plastic ring described above.

The invention is illustrated in the drawing by means of embodiments and will be explained in the following.

DETAILED DESCRIPTION OF THE DRAWINGS

Figure 1:
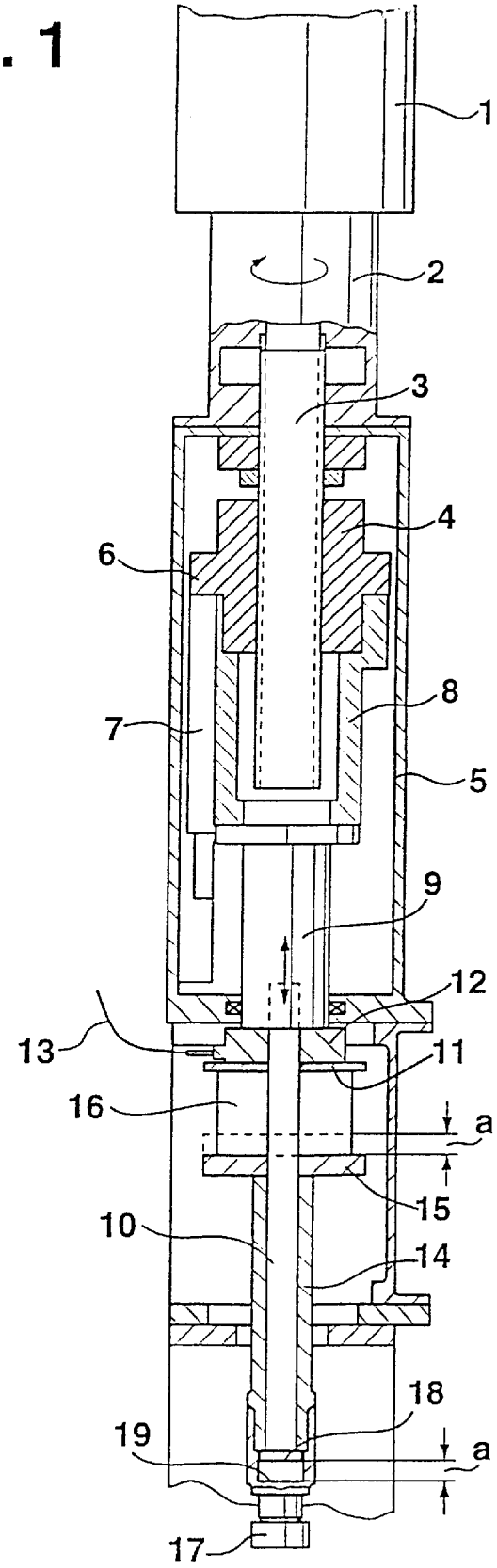
FIG. 1 is a view of a pressing-in unit for a hot-chamber pressure diecasting machine for processing molten metal.

In FIG. 1, an electric motor 1, for example, an asynchronous motor or other variants of servo motors, is provided which has a transmission, which is not shown in detail, and a coupling part 2 which drives a threaded spindle 3 to carry out a rotating movement. The threaded spindle 3 is guided in a protective housing 5 in a sealed manner. A nut 4 is guided on this spindle 3 and interacts with the thread of the spindle 3. This nut 4 engages by means of a guiding cam 6 in a groove 7 inside the housing 5 and is therefore non-rotatably guided in the housing 5. By way of an extension 8 reaching over the free end of the spindle 3, the nut 4 is connected with a pusher rod 9 which, in turn, extends in a sealed-off manner out of the housing 5 and is provided with an extension 10 of a smaller diameter. On the extension 10, a first disk 11 is movably guided which rests against a pressure sensor 12 which may be constructed, for example, in the manner of a piezoelectric element. By way of a signal line 13, this pressure sensor 12 is connected with a multiparameter regulator which is not shown because it is known and which regulates the motor 1.

Furthermore, a sleeve 14 with an end disk 15 is displaceably disposed on the extension 10, in which case a spring element in the form of a plastic ring 16 is arranged between the end disk 15 and the disk 11 resting against the pressure sensor 12. This plastic ring 16 is also penetrated by the extension 10. At the end facing away from the disk 15, the sleeve 14 is provided with a connection end 17 for the connection with the casting plunger which is not shown, the free end of the extension 10 being provided with a step 18 of a larger diameter which holds the sleeve on the extension 10 and can also be used for a certain prestressing of the plastic ring 16. This step 18 is away from an inner end surface 18 of the sleeve 14 by the distance a. The operation of this pressing-in unit will now be started for pressing molten metal in a known manner from the crucible of a hot-chamber pressure diecasting machine through the casting cylinder and an ascending pipe into the mold. Then the electric drive 1 is activated by way of the multiparameter regulator, which is not shown, for rotating the spindle 3, which has the result that the nut 4 moves from its illustrated position along the spindle 3 downward and in the process also presses the pusher rod 9 downward, specifically at the speed required for the filling operation of the casting mold.

When the mold is filled, the rotary drive of the spindle 3 must be switched from speed control to torque control and the motor 1 is braked for this purpose. Since the motor as well as the transmission, which is not shown in detail, and all parts caused to rotate by the drive have a mass-caused moment of inertia, it is not possible to immediately, starting from the point of time of the switch-over, prevent the continued rotation of the spindle 3. In order to avoid in this case that the casting plunger, which is not shown, continues to press onto the incompressible molten metal situated in the mold and undesirable pressure peaks are caused thereby in the molten metal or force peaks occur in the driving mechanism, which may result in damage, the spring element 16 is provided which compresses in this case and absorbs the path which otherwise the casting plunger would additionally have to cover. Because of the incompressibility of the molten metal in the mold, the casting plunger will virtually stand still after the filling of the mold, while the pusher rod 9 and its extension 10 continue to be moved a certain distance which can, however, be absorbed by the relative displaceability between, the sleeve 14 and the extension 10 by the spring element 16.

In this case, the arrangement is such that the distance still covered by the drive is shorter than the measurement a. The spring element 16 is therefore compressed by an amount slightly less than a and is therefore tensioned. In this case, the design can be such that, when the spring travel is adjusted—which is therefore smaller than a—a reaction force exercised by the spring element 16 acts upon the sleeve 14 and thus on the casting plunger and is sufficiently large for causing in the molten metal the required after-pressure as the result of a force, for example, in the order of from 7–8 tons (70–80 KN) The plastic ring used in the embodiment can apply these forces without being large in size. The use of a liquid spring would also be conceivable, in the case of which the compressibility of liquids, particularly of oil at high pressures, is utilized. The motor 1 can be controlled to a holding torque, so that no complicated measures are required for maintaining the after-pressure in the molten metal.

In order to, in each case, keep the force exercised by the spring element 16 so large that the required pressure is generated in the molten metal, the pressure sensor 12 is provided which emits a measurement for the force exercised by the spring 16 upon the sleeve 14 and thus on the casting plunger. As explained above, the disk 11 is displaceably arranged on the extension 10. The disks 11 and 15 are therefore acted upon by the same axial force. This force can be controlled to a very specific intensity by the above-mentioned multiparameter regulator and the driving motor 1 as long as it is provided that the deflection path for the spring element 16 is no larger than the measurement a.

Figure 2:
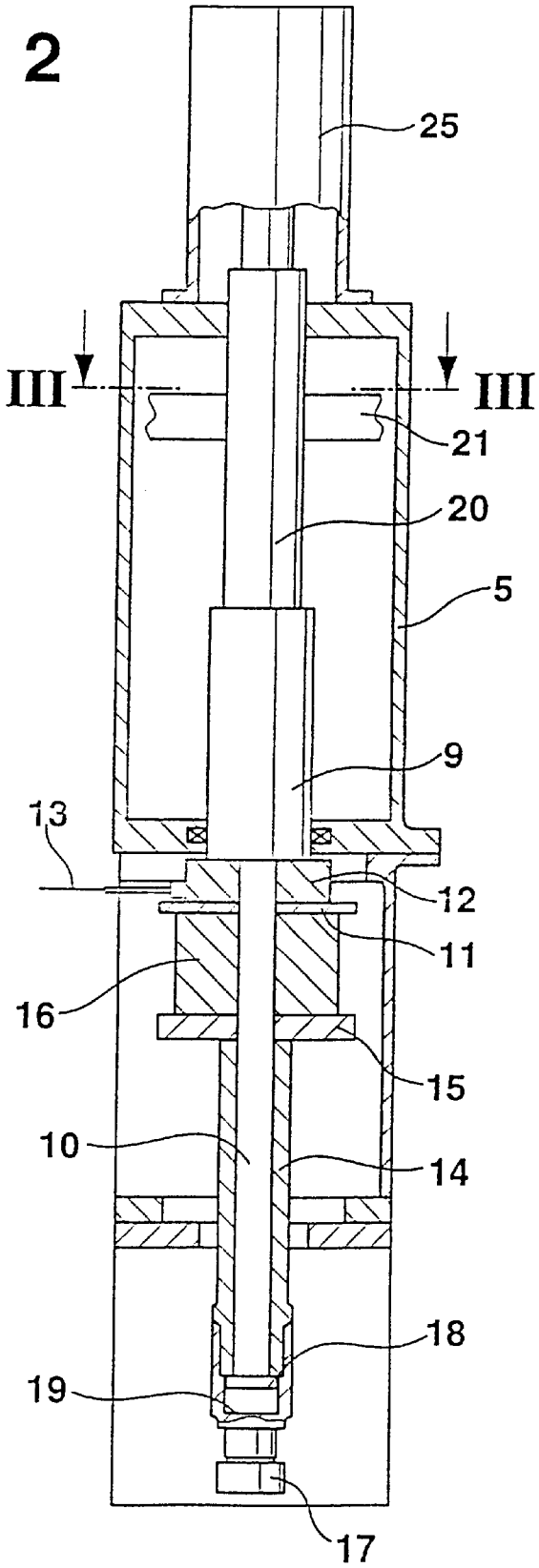
FIG. 2 is a view of a pressing-in unit similar to FIG. 1 but with a rack-and-pinion drive instead of a threaded spindle drive.

FIG. 2 is a schematic representation of a pressing-in unit similar to FIG. 1. The same reference numbers were therefore retained for identical parts.

The difference is that a toothed rack 20 is fixedly connected with the pusher rod 9. The spindle drive according to FIG. 1 is therefore not present. Like the spindle 3 of FIG. 1, the toothed rack 20 is guided in a sealed-off manner in the housing 5 and in the toothed-rack housing 25 which is closely connected with this housing 5. Transmission oil can therefore not leak out and possibly enter into the molten metal.

Figure 3:
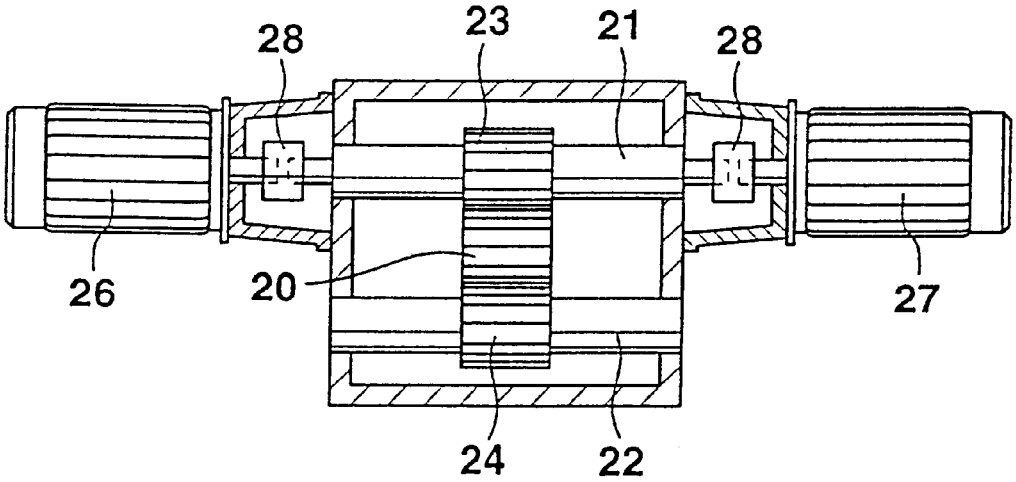
FIG. 3 is a schematic representation of a sectional view of the unit of FIG. 2 in the direction of the intersection line III—III.

As illustrated in FIG. 3, the toothed rack 20 is provided with a toothing on both sides and, by means of these toothings rests in each case on a pinion 23 and 24 which is disposed on one shaft 21 and 22 respectively. In this embodiment, the shaft 21 is driven, specifically by way of two motors 25 and 27 which are each in a driving connection with the shaft 21 by way of a coupling 28. A power adaptation can in each case take place by controlling the couplings 28 in so far as the drive of the toothed rack takes place only by way of one of the electric motors or by way of both electric motors 26 and 27. As a result of this further development, higher dynamics and a higher acceleration and deceleration can be exercised on the toothed rack 20. As a result, the adjusting speeds for the toothed rack and the pusher rod 9 can be maintained to be relatively high.

Figure 4:
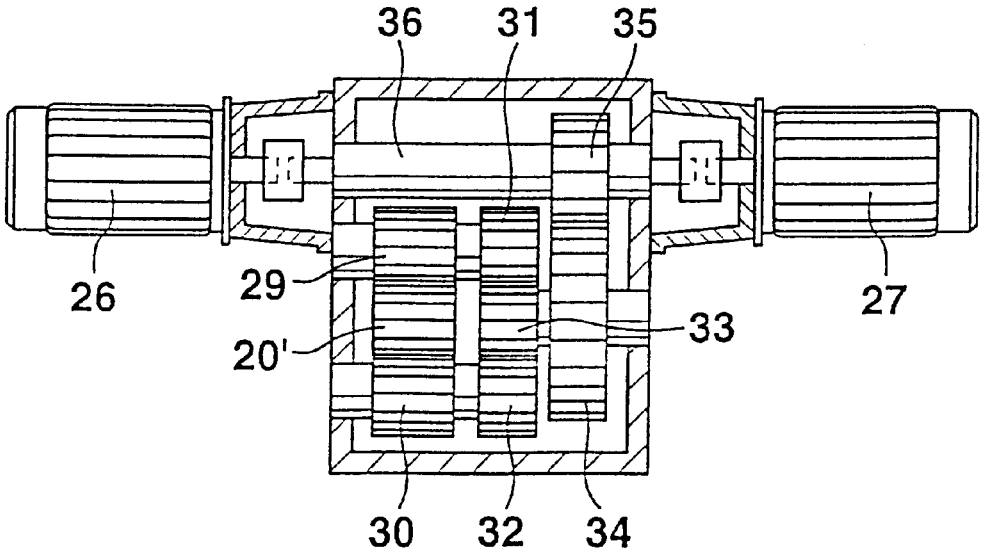
FIG. 4 is a representation similar to FIG. 3 but with another transmission arrangement for acting upon the rack.

FIG. 4 shows a toothed rack arrangement similar to that of FIG. 3 only that here the toothed rack 20' is driven by pinions 29 and 30 which, in turn, are part of a transmission consisting of additional pinions 31, 32, 33 and of the gears 34 and 35, in the case of which the gear 35, which is fixedly disposed on the shaft 36, is again optionally driven by one or both electric motors 26, 27. As a result of such a transmission arrangement, transmission ratios can be realized which ensure a particularly good functioning of the pressing-in unit.

Figure 5:
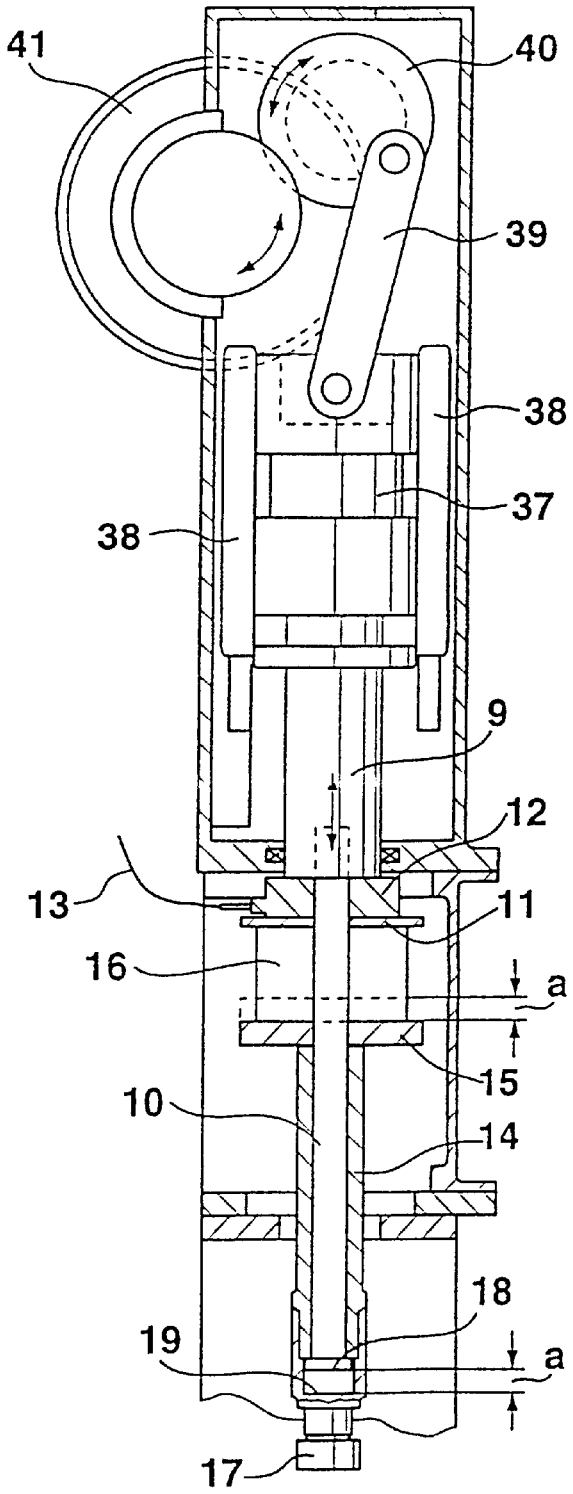
FIG. 5 is a view of a pressing-in unit for a hot-chamber pressure diecasting machine similar to FIG. 1, but with a crank drive for the pusher rods.

FIG. 5, in which reference numbers which refer to the same parts as those used in FIG. 1 were also retained, illustrates a deviation from the construction such that the pusher rods 9 are acted upon by a carriage 37 which is guided in a straight-line mechanism 38 in the direction of the axis of the pusher rods 9. This carriage 37 is acted upon by a connecting rod 39 which is actuated by a crank disk which, in turn, can be moved by way of a transmission not shown in detail by one or—or two—electric motors 41.

Figure 6:
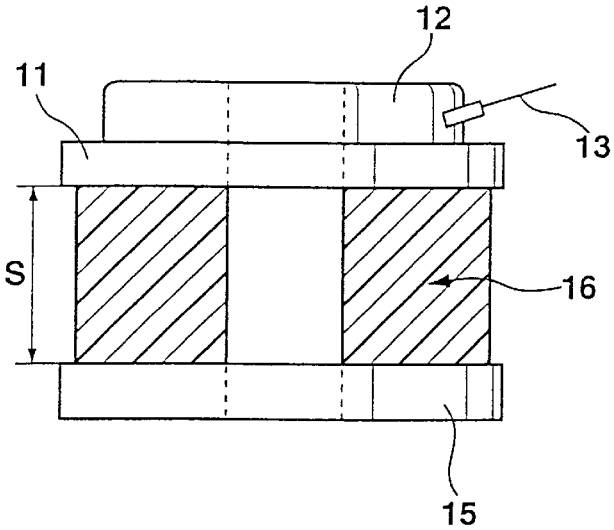
FIG. 6 is a schematic representation of the plastic spring used in FIGS. 1, 2 and 5.
Figure 8:
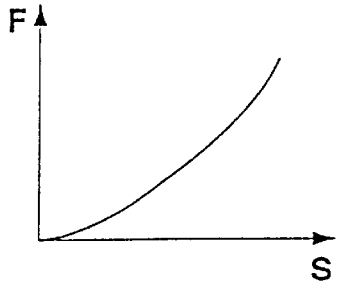
FIG. 8 is a view of the course of the force path caused by the plastic spring according to FIG. 6.

FIG. 6 shows the plastic ring 16, as used in all illustrated embodiments of FIG. 1, 2 or 5 as a spring element between the pusher rod 9 and the casting plunger. This plastic ring 16 consists of a coated polyurethane caoutchouc. It can then, when it is compressed in the direction of the arrow s, generate the force path characteristic illustrated in FIG. 8. In FIG. 8, F indicates the force and s indicates the deformation path of the plastic ring 16.

Figure 7:
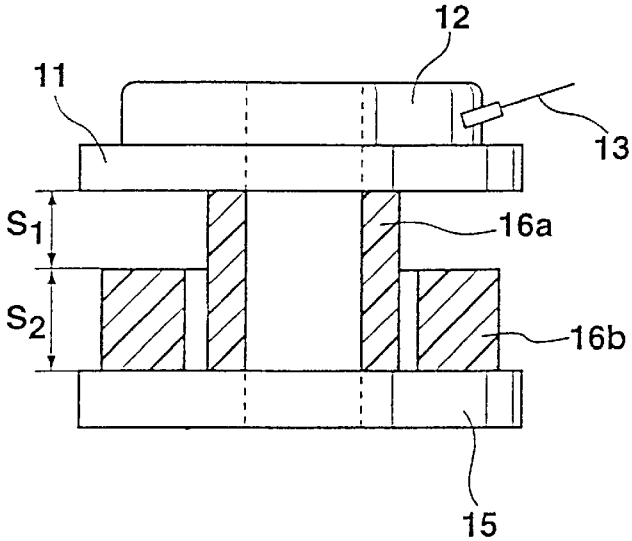
FIG. 7 is a view of a modified construction of the plastic spring according to FIG. 6.
Figure 9:
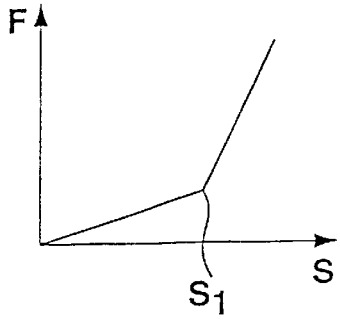
FIG. 9 is a view of the course of the force path when using a plastic spring according to FIG. 7.

FIG. 7 shows an embodiment in which the plastic ring 16 is replaced by two mutually concentrically arranged ring parts 16*a* and 16*b*, which can also consist of coated polyurethane caoutchouc and, according to FIG. 9, can generate a different path/force characteristic. When the plastic ring 16*a* is compressed by the amount S1, the force F exercised by it increased to a defined amount which is illustrated schematically in FIG. 9 when reaching the distance s1. However, when the two plastic rings 16*a* and 16*b* are further compressed beyond the distance s1 along the distance s2, they act jointly as a considerably stronger spring, so that the rise in force per distance unit becomes significantly larger. This further development can be utilized for increasing the pressure force exercised on the molten metal, without the requirement of high-expenditure control measures for the drive.

Figure 10:
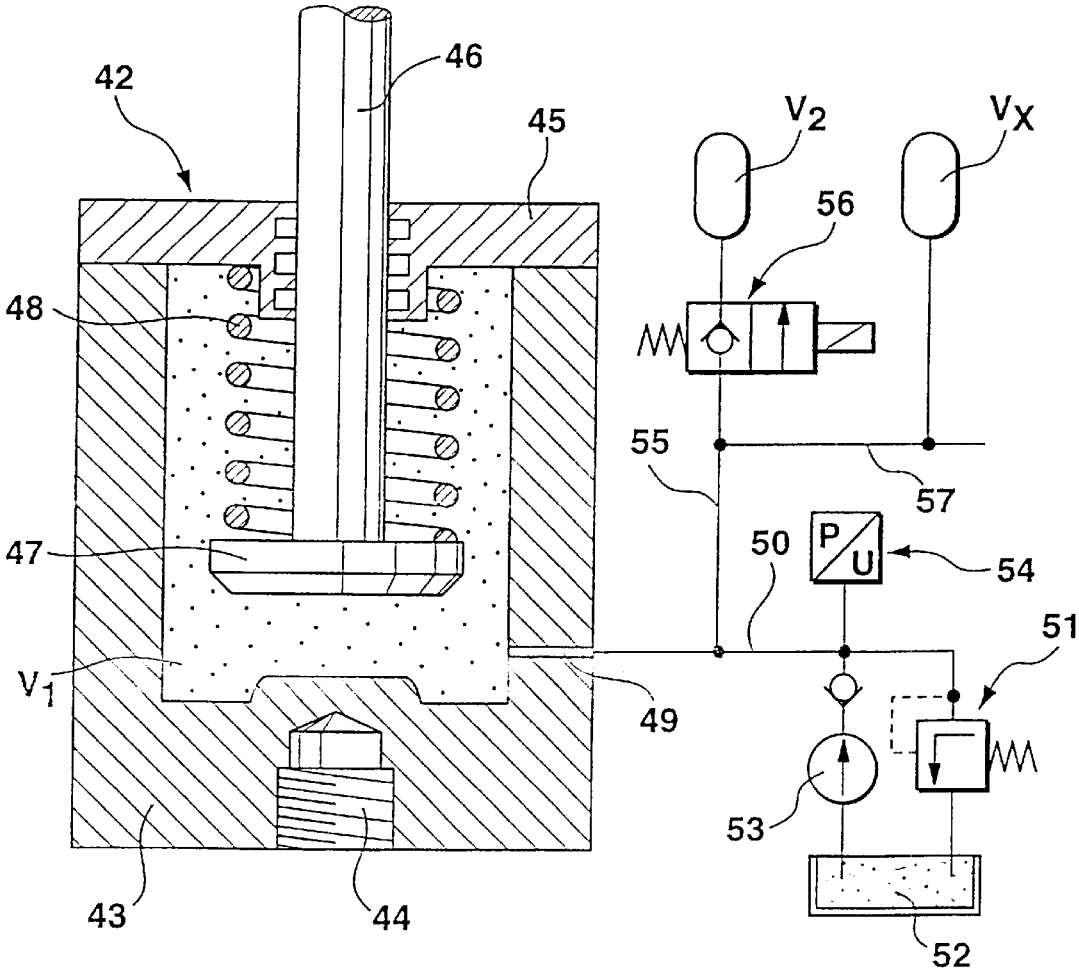
FIG. 10 is a view of an embodiment of a liquid spring which can be used instead of the plastic spring according to FIG. 6 or 7 between the pusher rod and the casting plunger of the pressing-in units.

FIG. 10 finally shows a liquid spring 42 which can be connected, instead of a plastic spring element, also between the pusher rod and the casting plunger. This liquid spring 42 consists of a stable cylinder 43 which is provided with a connection bore 44 for mounting a part provided with the connection part 17 (FIG. 1), which part, in turn, receives the casting plunger which is not shown. A piston rod 46, which is guided in a sealed manner in the lid 45, projects into the interior of the cylinder 43 which is closed by the lid 45 and which is filled by means of a volume $V_1$ of a pressure oil. At its lower end, this piston rod is provided with a plate-shaped attachment 47 which is acted upon by a pressure spring 48 supporting itself on the lid 45. This pressure spring 48 therefore presses the piston rod 46 by a defined amount into the volume $V_1$ so that, as a result, the pressure in the liquid contained in the cylinder 43 is increased by the piston rod 46 acting as a displacement body.

As indicated at the beginning, in the case of this liquid spring arrangement, the compressibility of liquids at very high pressures is utilized. Just as the above-mentioned plastic spring bodies, liquid springs are therefore suitable for absorbing the high forces occurring in the case of pressure diecasting machines.

In the illustrated embodiment, the cylinder 43 has an opening 49 which is connected by way of a connection line 50 with a pressure limiting valve 51. Liquid possibly flowing out by way of the pressure limiting valve 51 is collected in a schematically indicated container 52 and is returned by way of a pump 53 to the interior of the cylinder 43. A pressure strain converter 54, which may, in turn, be connected with the control of the electric driving motors, is connected to the connection line 50. In this manner, the desired pressing-in force onto the molten metal can be perfectly adjusted and maintained by way of the drive.

However, another line 55 which, by way of a control valve 56, permits the connection of an additional volume $V_2$ or—by way of the connection line 57—also the connection of additional volumes, which are schematically marked $V_x$, is also connected with the connection line 50. This further development allows a changing of the force path characteristics exercised by the liquid spring 52 in a similar manner and its adaptation to the respective requirements, as was explained by means for FIG. 9 for the two-part plastic ring.

As a result of the further development according to the invention, a firm relationship therefore exists between the deflection path (which is preferably smaller than a—FIG. 1—of the spring element 16 or 42 and the axial force exercised on the casting plunger. The invention therefore permits the drive of a pressing-in unit for hot-chamber pressure diecasting machines by electro-mechanical means and offers the advantage of a relatively simple controlling and regulating.

What is claimed is:

1. Pressing-in unit for a hot-chamber pressure diecasting machine for processing molten metals, having a casting plunger for pressing casting material into a mold, which said casting plunger can be acted upon by way of a pusher rod which is connected with a linear drive driven by an electric motor, said linear drive, after a filling phase of the mold, being held in a pressure phase for achieving a necessary pressure in the casting material, a spring element being connected between the casting plunger and the pusher rod, wherein the spring element comprises one of an elastic plastic component and a liquid spring and provides a reaction force onto the casting plunger caused by stress of the spring element large enough for applying an axial force required for achieving the necessary pressure in the casting material during the pressure phase.

2. Pressing-in unit according to claim 1, wherein a sensor, which is connected with the control of the drive and detects the axial force exercised by the spring element, is assigned to the control of the drive.

3. Pressing-in unit according to claim 1, wherein the electric linear drive can be controlled such that the spring element is not compressed beyond a defined extent.

4. Pressing-in unit according to claim 1, wherein the spring element is an elastic plastic ring which is held between two disks of which one is held on the pusher rod and the other is fixedly connected with a sleeve telescopically guided on the pusher rod.

5. Pressing-in unit according to claim 4, wherein the plastic ring is constructed of two or more parts which can be successively deformed.

6. Pressing-in unit according to claim 1, wherein the spring element comprises a plastic component (16, 16*a*, 16*b*) which consists of a coated polyurethane caoutchouc.

7. Pressing-in unit according to claim 4, wherein the pusher rod has an extension of a smaller diameter which penetrates the spring element, formed as a plastic ring, and on which the sleeve is guided.

8. Pressing-in unit according to claim 4, wherein the spring element and the arrangement of the sleeve are mutually coordinated such that an extension can only be adjusted a certain distance relative to the sleeve.

9. Pressing-in unit according to claim 2, wherein the sensor rests on a step formed between the pusher rod and an extension of a smaller diameter and on a disk which is guided on an attachment and adjoins the spring element.

10. Pressing-in unit according to claim 1, wherein a threaded drive is provided as the linear drive which comprises a spindle and a nut guided thereon.

11. Pressing-in unit according to claim 1, wherein a rack-and-pinion drive is provided as the linear drive.

12. Pressing-in unit according to claim 11, wherein the drive of a toothed rack of the rack and pinion drive takes place by way of a transmission which is applied to both sides of the toothed rack.

13. Pressing-in unit according to claim 12, wherein two motors are optionally provided for driving the transmission.

14. Pressing-in unit according to claim 1, wherein the linear drive is a carriage which is driven by a connecting rod of a crank drive and is held in a straight-line mechanism.

15. Pressing-in unit according to claim 1, wherein the spring element is a liquid spring which comprises a cylinder with an immersion plunger rod, the immersion plunger rod being pressed by force of a spring into an interior of the cylinder in order to subject a liquid to a defined prestress even before being acted upon by the pusher rod.

16. Pressing-in unit according to claim 15, wherein the cylinder of the liquid spring is provided with an opening to which an excess pressure limiting valve and a pump are connected for possible returning of leaked-out liquid.

17. Pressing-in unit according to claim 16, wherein a pressure strain converter is connected to a connection line to the pressure limiting valve and is connected with the control of the electric driving motor.

18. Pressing-in unit according to claim 16, wherein additional liquid volumes are connected to the connection line, the controllable connection of said volumes contributing to changing the spring characteristic.

19. Pressing-in unit according to claim 2, wherein the electric linear drive can be controlled such that the spring element is not compressed beyond a defined extent.

20. Pressing-in unit according to claim 19, wherein the spring element is an elastic plastic ring which is held between two disks of which one is held on the pusher rod and the other is fixedly connected with a sleeve telescopically guided on the pusher rod.

21. Pressing-in unit according to claim 4, wherein the spring element comprises a plastic component which consists of a coated polyurethane caoutchouc.

22. Pressing-in unit according to claim 1, wherein the spring element is a liquid spring which comprises a cylinder with an immersion plunger rod, the immersion plunger rod being pressed by the force of a spring into the interior of the cylinder in order to subject the liquid to a defined prestress even before being acted upon by the pusher rod.

23. Pressing-in unit for a hot-chamber pressure diecasting machine for processing molten metals, which has a casting plunger for pressing casting material into a mold, which said casting plunger can be acted upon by way of a pusher rod which is connected with a linear drive, which said linear drive, after a filling phase of the mold, is held in a pressure phase for achieving a necessary pressure in the casting material, a spring element being connected between the casting plunger and the pusher rod, wherein the spring element is configured such that reaction forces onto the casting plunger caused by the spring element are large enough for applying an axial force required for achieving the necessary pressure in the casting material, wherein the spring element is an elastic plastic ring which is held between two disks of which one is held on the pusher rod and the other is fixedly connected with a sleeve telescopically guided on the pusher rod.

24. Pressing-in unit according to claim 23, wherein a sensor, which is connected with the control of the drive and detects the axial force exercised by the spring element, is assigned to the control of the drive.

25. Pressing unit according to claim 23, wherein control means are provided for controlling the linear drive such that the spring element is not compressed beyond a defined extent.

26. Pressing-in unit according to claim 23, wherein a threaded drive is provided as the linear drive which comprises a spindle and a nut guided thereon.

27. Pressing-in unit according to claim 23, wherein a rack-and-pinion drive is provided as the linear drive.

28. Pressing-in unit according to claim 23, wherein the linear drive is a carriage which is driven by a connecting rod of a crank drive and is held in a straight-line mechanism.

* * * * *